United States Patent [19]

Giebel et al.

[11] 3,995,341

[45] Dec. 7, 1976

[54] SHOE MACHINE

[75] Inventors: Gerhard Giebel, Neuenhain, Taunus; Rolf Klein, Pirmasens, both of Germany

[73] Assignee: USM Corporation, Boston, Mass.

[22] Filed: Mar. 12, 1976

[21] Appl. No.: 666,236

[30] Foreign Application Priority Data

Mar. 14, 1975 Germany ..... 2511366
Mar. 14, 1975 Germany ..... 7508203[U]

[52] U.S. Cl. ..... 12/10.1
[51] Int. Cl.[2] ..... A43D 21/00
[58] Field of Search ..... 12/10.1, 10.5, 12, 8.5, 12/7, 145

[56] References Cited

UNITED STATES PATENTS

| | | | |
|---|---|---|---|
| 3,729,758 | 5/1973 | Schindler et al. | 12/10.1 |
| 3,852,841 | 12/1974 | Schindler et al. | 12/10.5 |

*Primary Examiner*—Patrick D. Lawson
*Attorney, Agent, or Firm*—Donald N. Halgren; Richard B. Megley; Vincent A. White

[57] ABSTRACT

A shoe machine for pulling and lasting shoe uppers and insoles on lasts has a pair of wiping elements, one operating heelwardly of the other in the joint region. After the upper has been pulled over and the insole has been cemented, the first wiping elements wipe in the upper margin at the joint with a toeward motion, which wiping elements then retract. The second wiping elements wipe in adjacent portions of the lasting margin, the wiping action of the second wipers overlapping that of the first wiping elements to wipe down any creases formed thereby. The main toe wiper plates operate to wipe in the toe and forepart portions of the upper. The insole cementing plate has heelward extensions hinged thereto which are yieldably urged upward by springs. Cement is fed to the extensions via passageways in their connective pivot pins.

10 Claims, 15 Drawing Figures

Fig. 5
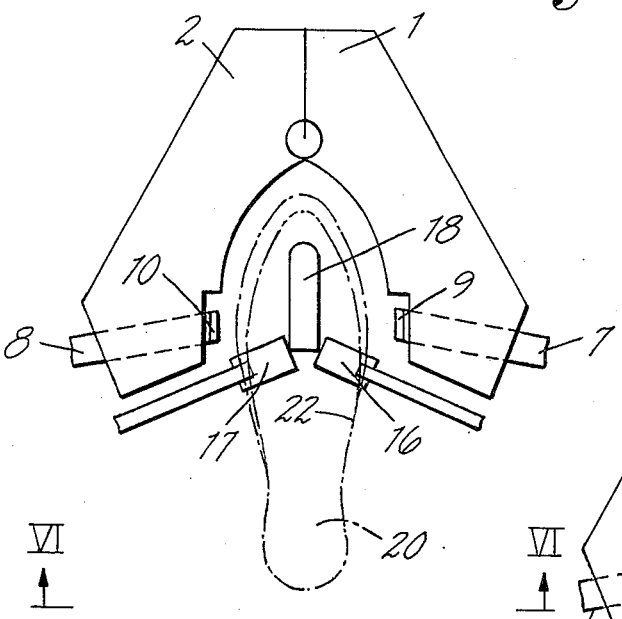
Fig. 7
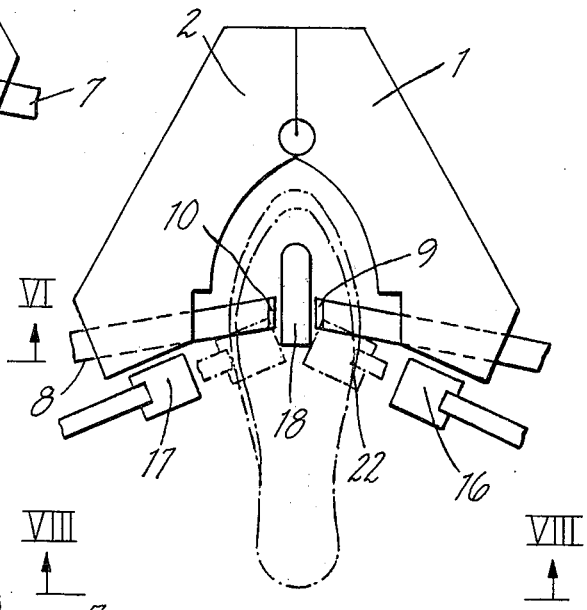
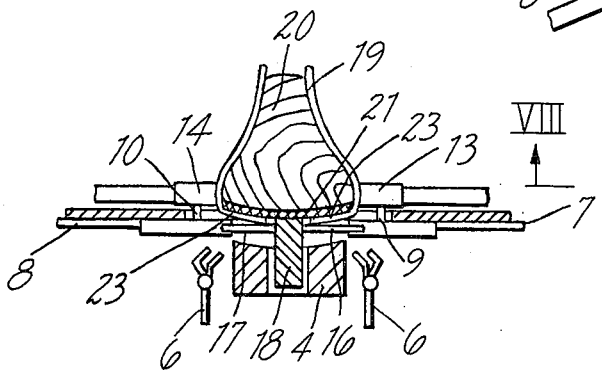
Fig. 6
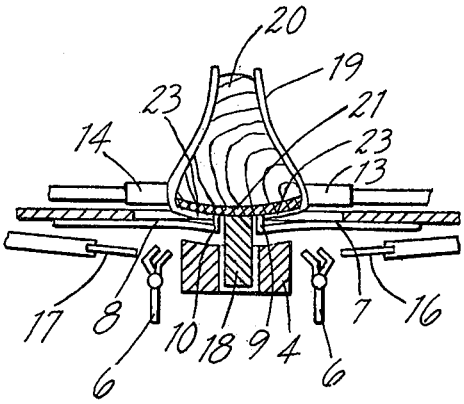
Fig. 8

Fig. 9
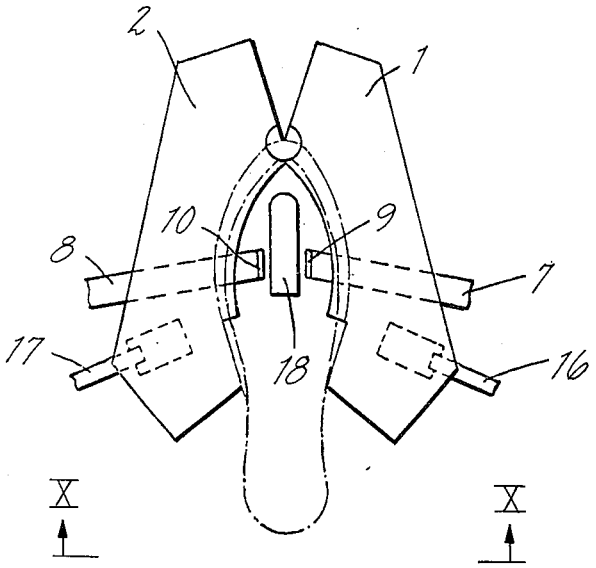
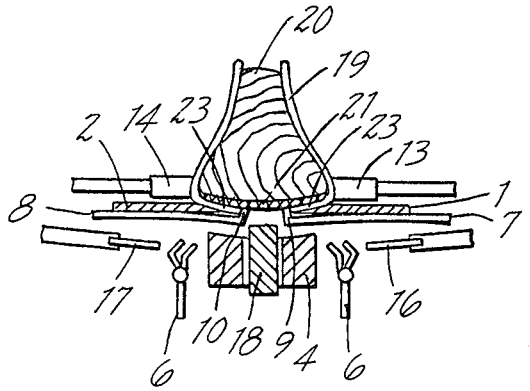
Fig. 10

SHOE MACHINE

BACKGROUND OF THE INVENTION

1. Field of the Invention

This invention concerns shoe machinery and more particularly relates to a method and a machine for the cement lasting of on-last footwear, in the toe and ball zones.

2. Prior Art

In order to carry out cement lasting in the toe and ball zones on a machine, the procedure has hitherto been that first the toe zone has been lasted by means of a lasting wiper and after that the lasting operation continued in the ball zone by means of a wiper. In the course of these operations the lasting margin in the ball zone was pushed backward so that between the ball zone and the waist an open pocket was formed by the lasting margin, constituting a hindrance for the subsequent lasting of the waist zone.

This problem has been attacked by a method in which the lasting operations are reversed in their sequence, by which a wiper directed substantially vertically to the shoe edge is first allowed to move in, in order to activate the lasting wiper for the toe lasting which followed. In this procedure, however, a fold occurs in the lasting margin between the zone of function of the wiper and the zone of function of the lasting wiper, and it cannot be uniformly joined to the insole by the run-in of the lasting wiper which is the final operation. Hence, the latter method has likewise not been able to establish itself in practice.

SUMMARY OF THE INVENTION

The invention has the basic aim of arranging the lasting operation in the zones of the toe and ball of a shoe on a machine in such a way that, on the one hand, the folds formed thereby in the lasting margin distribute themselves uniformly whilst, on the other hand, the transition of the lasting margin to the waist zone lies smoothly on the insole after the lasting operation has taken place.

The problem is solved by the expedient that the ball zone is lasted as the first step in the operation by an arrangement of ball wipers directed obliquely forward. In a second step in the operation, directly after the drawing back of the ball wipers, fold distributors are pushed over the lasting margin with only their front edges pressing resiliently against the shoe bottom, approximately to the shoe edge, and overlapping the zone of operation of the ball wipers. In a third step in the operation, a lasting wiper is arranged between the shoe bottom and the fold distributors, its zone of operation covering that of the fold distributors.

By the ball wipers, which operate in the first stage, operating obliquely forward, the lasting margin has a tendency to be pushed forward in addition to the pull inward, whereby the still unlasted lasting margin in the waist zone lies flat on the insole. The fold thereby formed in the lasting margin in front of the ball wipers is then uniformly distributed over the insole by the fold distributors, in the second stage, because the fold distributors pull inwardly, approximately vertically to the shoe edge and overlapping the zone of operation of the ball wipers. As a result, the crease arising from the previous effect of the ball wipers disappears. As the cement between insole and lasting margin has now, by the pressure exerted on the lasting margin by the ball wipers, been relatively thinly distributed, and thereby deprived of some of its heat, there occurs here a quick setting of the cement so that after the withdrawal of the ball wipers and the operating of the fold distributors the lasting margin in the ball zone remains firmly in place and cannot, in consequence, displace itself backward in the direction of the waist zone. The requirement is thus met that the lasting margin should fit to the insole. Now, in the third stage, the lasting wipers move in, encountering in the ball zone a lasting margin uniformly cemented to the insole with a uniform distribution of creases so that no undesired creases can form in this lasting operation, especially at the transition to the ball zone. The lasting wipers are not hindered by the fold distributors, since the latter press only with their front edge against the shoe bottom, and the lasting wipers are arranged between shoe bottom and fold distributors. The lasting wipers can, therefore, move inwardly in a gap between fold distributors and lasting margin.

If a cement is being used which does not set particularly quickly, it is appropriate to give additional stability of the fixation of the upper on the last. For this purpose, before the moving in of the ball wipers, the upper is held by the application of a toe band and after the moving in of the ball wipers by side pressure rams arranged above the said wipers. By this means the difficulty is avoided whereby a cement that might possibly not be completely set allows the lasting margin to pull back under the tension in the upper after the withdrawal of the ball wipers.

The pulling-over and cement lasting machine is arranged in such a way that the ball wipers, directed obliquely forward, are arranged laterally to the on-last shoe, and the lasting wipers with the fold distributors are fitted on a wiper head that can be moved toward and away from the shoe.

In order now that the ball wipers can adapt themselves without difficulty to the course of the shoe bottom in the latter's longitudinal direction, they are mounted on the end of piston rods. The piston rods execute a thrust movement a stroke movement directed toward the shoe bottom, whereby the ball wipers, for the purpose of self-acting adaptation to the course of the shoe bottom in its longitudinal direction, are rotatably mounted about their longitudinal axis. The stroke movement of the piston rod is permitted due to its connection with a piston-cylinder unit which is mounted rotatably about an axis parallel to the shoe bottom support. By this mounting and movement capability of the piston rod, with the ball wiper seated thereon, the latter, in its forward movement, is first pressed on the lasting margin from below, just behind the insole edge, and by reason of its capability of rotation about its longitudinal axis it conforms with the course of the shoe bottom in the latter's lengthwise direction. In the subsequent, purely forward movement, the lasting margin is then drawn inwardly, in its position imposed by the shoe bottom, and drawn obliquely forward on account of the direction of the wiper. In addition, there naturally occurs also a pressing of the lasting margin on the insole, whereby the cement lying between them sets.

In order to ensure always the same initial setup of the ball wiper when it is returned to its starting position, after having been rotated about its longitudinal axis owing to the corresponding course of the shoe bottom, the piston rod activating the ball wiper is provided with a laterally protruding pin which slides in a guide which widens in shape in the direction of movement. By reason of this widening, the piston rod can rotate. When the piston rod slides back into its starting position, the pin impinges upon the guide, which then, by reason of its wedge shape, guides it back into its starting position, the piston rod being thereby correspondingly rotated back.

The fold distributors are appropriately constructed of flat springs which are provided with bends directed to the shoe bottom at their ends. This imparts to the fold distributors the capability of following the curve of the shoe bottom by reason of their flexibility.

In the opened condition of the lasting wiper, its edge which serves for the lasting is immediately adjacent to the bends in the fold distributors. In order now that the fold distributors can be drawn back sufficiently far so that they do not yet come into contact with the shoe in their forward movement, recesses are suitably provided in the lasting wiper for the bends of the fold distributors, and the bends are positioned in these recesses. This yields the advantageous result that the lasting wiper needs to be less widely opened by the depth of the said recesses.

For the cement lasting of the ball zone too, it is necessary to deliver cement to this zone. For this, an injector plate delivering the cement is appropriately divided in such a way that in the ball zone it is formed by a rotatable extension piece hinged to the part of the injection plate in front of it, and pressed against the ball zone by spring pressure. In this way the injector plate can automatically adapt itself to a springing of the waist.

Cement is appropriately supplied to this rotatable extension piece through borings in its axes, and ring grooves connected thereto, from which the cement reaches the surface of the extension piece through apertures.

BRIEF DESCRIPTION OF THE DRAWINGS

An embodiment example of the invention is explained below with reference to the drawings in which:

FIG. 5 is a view similar to FIG. 3 but with the ball wipers moved in;

FIG. 6 is a view taken along the lines VI—VI of FIG. 5;

FIG. 7 is a view similar to FIG. 5 but with the ball wipers withdrawn and the fold distributors moved forward;

FIG. 8 is a view taken along the lines VIII—VIII of FIG. 7;

FIG. 9 is a view similar to FIG. 7 but with the lasting wiper moved in;

FIG. 10 is a view taken along the lines X—X of FIG. 9:

DESCRIPTION OF THE PREFERRED EMBODIMENT

Figure 1:
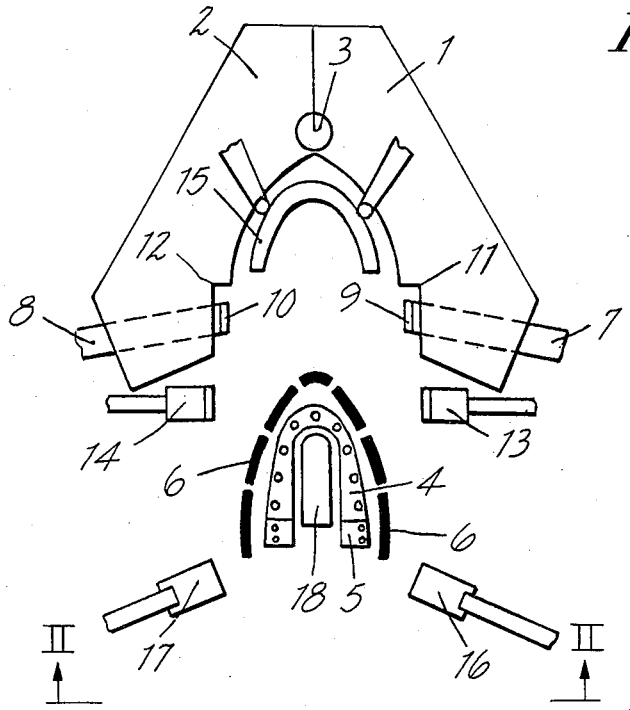
FIG. 1 is a diagrammatic presentation of the machine in the starting position.

FIG. 1 shows a portion of a shoe machine for pulling and lasting shoe uppers and insoles on lasts comprising a pair of lasting wipers 1, 2 which can be rotated about a common axis 3. An injection plate arrangement 4, 5 delivers cement to the toe zone of a shoe bottom while the extension 5 delivers cement to the ball zone of a shoe bottom. Around the injection plate 4, 5 pincers are arranged, indicated only by the thick lines 6.

A pair of fold distributors 7, 8 consisting of spring steel strips having at their inner ends a bend 9 and 10 are shown in combination with the lasting wipers 1, 2. The bends 9 and 10 are each located, when not in use, in a recess 11 and 12 in their respective lasting wipers 1 and 2. The bends 9 and 10 are directed upward (thus, projecting out of the plane of the drawing upward toward the observer). The fold distributors 7 and 8 together with the lasting wipers 1 and 2 are fitted on the wiper head, not shown here, which for the lasting of the shoe moves up to the latter in a known way and thus correspondingly approaches the injection plates 4 and 5.

Beneath the lasting wipers 1 and 2 are arranged a pair of side pressure rams 13 and 14 which, together with a toe band 15, hold the on-last upper in a known way.

FIG. 1 also shows an arrangement of two ball wipers 16 and 17 which are directed obliquely forward.

Figure 2:
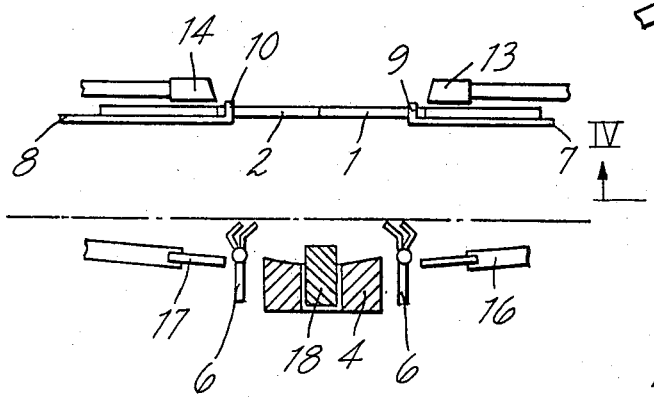
FIG. 2 is a view taken along the lines II—II of FIG. 1.

FIG. 2 is presented in the plane of the lasting wipers 1, 2. As can be seen, the lasting wipers 1, 2, the fold distributors 7 and 8, and the side pressure rams 13 and 14, are in a position offset above the injection plate 4 which is shown here in section. In FIG. 2, however, the position into which the lasting wipers 1, 2 are brought immediately before the lasting operation is indicated by the line broken by dots. FIG. 2 shows two pincers 6 and the ball wipers 16, 17. A shoe last support 18 is also shown inside the injection plate 4.

Figure 3:
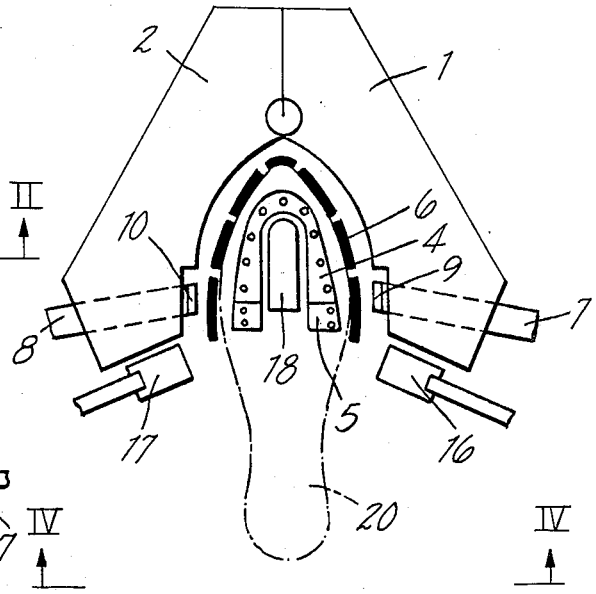
FIG. 3 is a view of the machine wherein the lasting wiper has moved up to the shoe.
Figure 4:
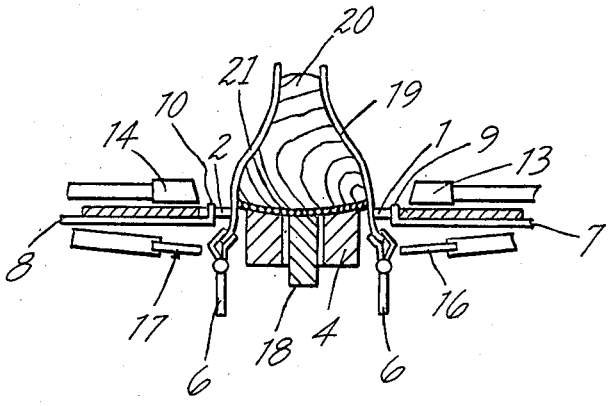
FIG. 4 is a view taken along the lines IV—IV of FIG. 3.

The wiper head, with the wipers 1, 2, the fold distributors 7, 8 and the side pressure rams 13, 14, now travels out of the position shown in FIG. 1 into the position shown in FIG. 3, but for greater clarity the side pressure rams are omitted from FIG. 3. This process of the moving up of the lasting wiper to an on-a-last shoe is already known. In this position the edges of the lasting wipers 1, 2 position themselves precisely on a shoe upper 19 which has been pulled over by the pincers 6. FIG. 4 shows this in a view in the plane of the lasting wipers 1, 2. The shoe upper 19 is thereby drawn tightly over a last 20 and prepared for a later lasting operation. The injection plate has been moved upward and impinges on an insole 21. The last 20 is thereby carried by the last support 18.

In FIG. 4 the two ball wipers 16, 17 are shown somewhat lower than their real position in order to avoid obscuring the lasting wipers 1, 2 and the fold distributors 7, 8. The toe band 15 and the side pressure rams 13, 14 (not shown in FIG. 3) press against the last 20.

In FIG. 5 the moving forward of the ball wipers 16, 17 represents the first stage of the machine operation. The obliquely forward alignment of the ball wipers 16, 17 causes the lasting margin 23 to be drawn slightly forward and is hence stretched in its waist zone 22, as is particlarly desirable for the subsequent lasting of the waist zone. Thus, in the waist zone no undesired creases can form in the lasting by the ball wipers 16, 17. In front of each ball wiper, however, in the direction of the point of the toe, a fold in the lasting margin 23 occurs which is uniformly distributed by the fold distributors 7, 8 in the following stage of the process.

Referring to FIG. 6, the line of vision is approximately in the plane of the lasting wipers 1, 2. It can be seen that the ball wipers 16, 17 have drawn the lasting margin 23 inwardly around the insole 21. The injection plate 4 had already dropped before the moving in of the ball wipers 16, 17, having previously provided the edge of the insole 21 with cement in a known way. It is also shown in FIG. 6 how in this phase the shoe upper 19 is additionally held by the side pressure rams 13, 14. The pincers 6 opened when the ball wipers 16, 17 moved in.

In FIG. 7 there is shown the fold distributors 7, 8 which distribute the creases formed in front of the ball wipers 16, 17. Prior to the moving in of the fold distributors 7, 8 the ball wipers 16 and 17 were withdrawn into the starting position shown in FIG. 7. They could be withdrawn from the shoe in this phase because, as a result of rapid loss of heat, the cement immediately sets with the pressing of the lasting margin 23 on the insole 21.

As can be seen from FIG. 8, the fold distributors 7, 8 with their bends 9, 10 slide over the lasting margin 23, where they resiliently yield to some extent to exert a slight pressure upon the lasting margin 23. The creases that halted in front of the ball wipers 16, 17 are thereby pressed against the insole 21 over which they distribute themselves uniformly. The fold distributors 7, 8 with their bends 9, 10 move so far in that they halt directly in front of the last support 18. At the end of this working phase the shoe is lasted in the ball zone by the ball wipers 16 and 17 and, immediately in front of the latter, by the fold distributors 7, 8. The obliquely forwardly directed movement of the ball wipers 16, 17 causes a pull in the forward direction to be exerted on the lasting margin 23, resulting in a smooth laying of the lasting margin in the waist zone 22. The fold distributors 7, 8 ensure that the lasting margin 23 rests smoothly on the insole 21 in front of the lasted ball zone. Hence, the shoe in this condition offers the ideal prerequisites for the remaining lasting in the toe point zone.

The final stage in the process, the moving in of the lasting wipers 1, 2, is shown in FIGS. 9 and 10. This inward move of the lasting wipers 1, 2 is not hindered by the ball wipers 16, 17. The latter, as explained above, have already withdrawn. In their sweep, the lasting wipers 1, 2 also overlap the zone of action of the fold distributors 7, 8, so they then additionally ensure that there is a uniform distribution of the creases in the zone of both of the fold distributors 7, 8 and of the ball wipers 16 and 17. Appropriately for the purpose, the lasting wipers 1, 2 extend into the zone of action of the ball wipers 16, 17.

The lasting wipers 1, 2 are not hindered in this sweep by the fold distributors 7, 8 since the latter, as a result of their bends 9, 10, provide a space under the lasting margin 23 into which the lasting wipers 1, 2 can freely sweep. FIG. 10 shows the lasting wipers 1, 2 lying in the moved-in position between the lasting margin 23 and the fold distributors 7, 8. At the end of the lasting operation, shown in the FIGS. 9 and 10, the last support 18 is lowered in a known way.

The shoe is now completely lasted from the point of the toe to the ball zone. The creases automatically arising from the rounded shape of the shoe were uniformly distributed along the lasting margin. Thus, in this lasting operation no upstanding creases can occur which otherwise would disturb the roughing operation.

It can be seen from FIGS. 2, 4, 8 and 10 that the ball wipers 16, 17 assume a slightly oblique position in their rest position, thus ensuring that the lasting wipers 1, 2, situated above them, can sweep in unhindered. The ball wipers 16, 17, during their sweep, are swivelled slightly in the direction of the insole 21 so that they grip the lasting margin 23 and press it against the insole 21.

Figure 11:
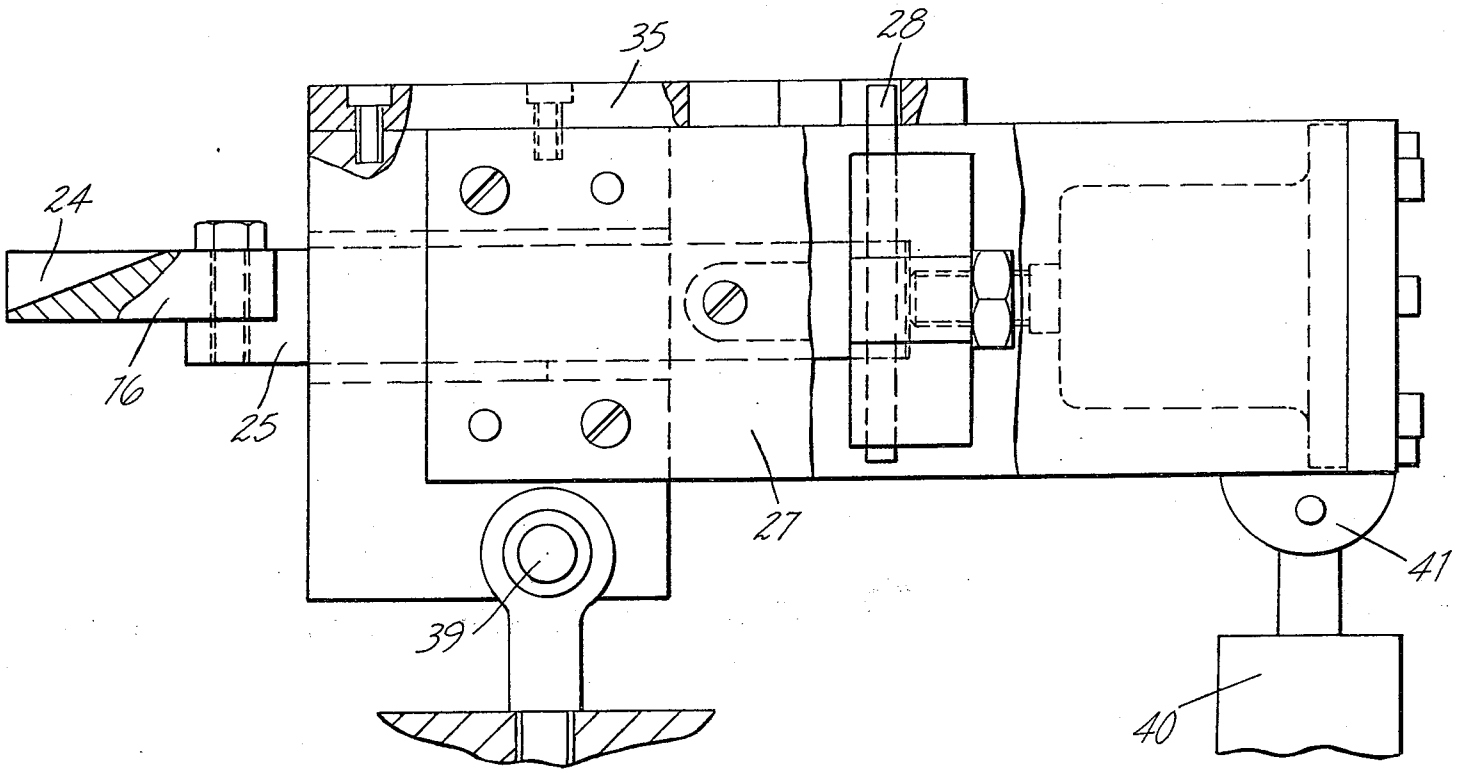
FIG. 11 is a view of the mounting of the ball wiper.
Figure 12:
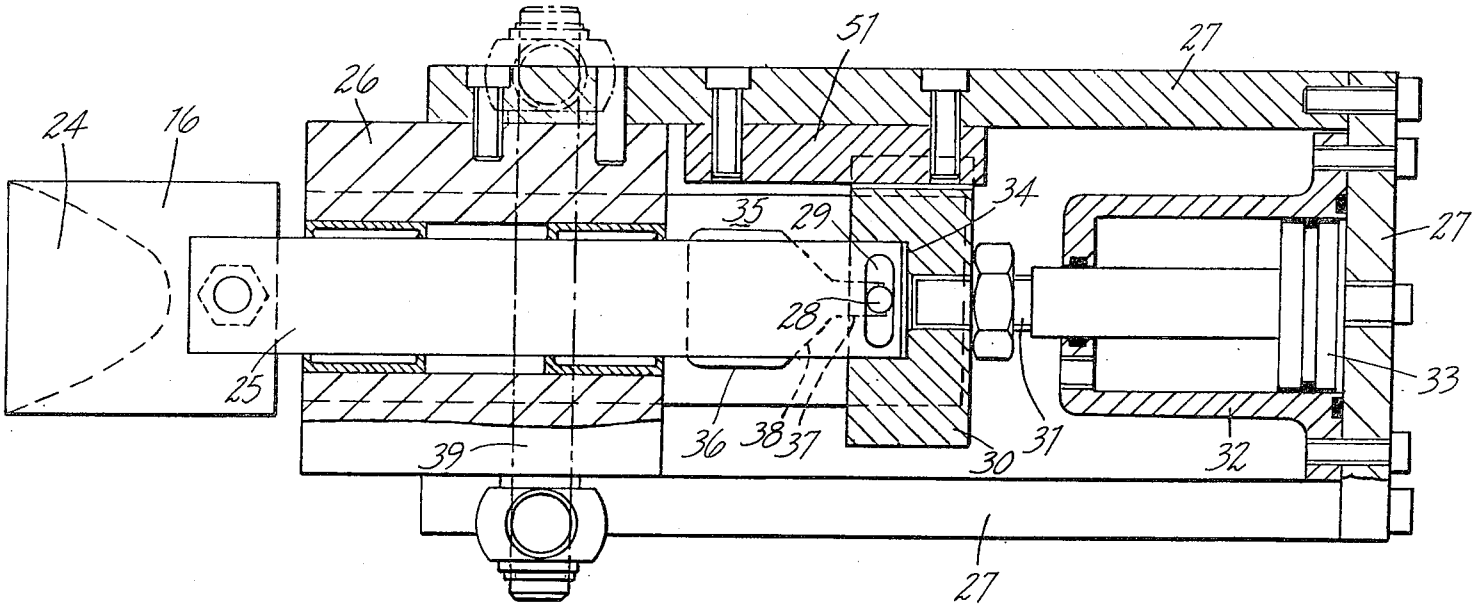
FIG. 12 is a view of the arrangement according to FIG. 11, in a position rotated around 90°.

The mechanism for activation of the ball wipers 16, 17 is shown in FIGS. 11 and 12. FIG. 12 shows a view of the assembly according to FIG. 11 in a position after rotation through 90°.

The assembly represented in FIGS. 11 and 12 shows the single ball wiper 16, which on the side directed toward the lasting margin has a slight inward curvature 24 by which the ball wiper 16 can effectively adapt itself to corresponding curvatures in the shoe. The ball wiper 16 is secured on a shaft 25 which is carried by a bearing bushing 26. The shaft 25 extends through the bearing bushing 26 into a housing 27 and carries at its end a radially protruding pin 28. The pin protrudes into a slot 29 in a follower 30 which is secured to the end of a piston rod 31. The piston rod 31 is a component of a cylinder 32 and a piston 33 arrangement. The piston-cylinder arrangement 31, 32, 33 is activated pneumatically in a known way. With the displacement of piston 33 to the left, the piston rod 31 presses its end against the shaft 25, whereby the ball wiper 16 is correspondingly displaced. The displacement of the ball wiper 16 carries out the lasting operation. With the retraction of the piston 33 into the position shown, the piston rod 31 takes with it the follower 30 fixed to its end, whereby a traction force is exerted upon the pin 28 protruding into the slot 29, and as a result the pin 28 seated in the shaft 25 moves the shaft 25 and the ball wiper 16 therewith.

The slot 29 during the rest position of the ball wiper 16, as represented in FIG. 12, takes the pin 28 in approximately its middle portion. The follower 30 containing the slot 29 is prevented from rotating by means of a guide bar 51. During the oscillating movement of the piston rod 31 and the follower 30, the slot 29 therein always assumes the same angular position regardless of the longitudinal displacement of the shaft 25.

The mounting of the ball wiper 16 on the shaft 35 imparts to the wiper 16 the possibility of rotating the shaft's 35 longitudinal axis. The ball wiper 16 can therefore adapt itself automatically as it travels forward to the "spring" of the shoe that is being lasted. The slot 29 allows the pin 28 sufficient tolerance to allow the latter to rotate with the shaft 25. This rotation of the shaft 25 exerts no influence upon the piston rod 31 since in the lasting process, i.e., in the displacement of the shaft 25 from right to left, only the left-hand end of the piston rod 31 presses upon the right-hand face 34 of the shaft 25. The friction occurring at this point is, however, small so that the shaft 25 can, as explained above, easily adapt itself to the "spring". In this, as can be seen, the piston rod 31 does not need to be conjointy rotated where considerable friction would have to be overcome between piston 33 and cylinder 32.

On the housing 27 a guide plate 35 is mounted which is provided with a guide 36 widening in a wedge shape in the thrust direction of the shaft 25. This guide has the followng tasks: In the thrust of the shaft 25 for the succeeding lasting operation, the pin 28 first slides in a narrow part 37 toward the left until the pin 28 arrives in a wedge shaped part 38 of the guide 36. From here onward the pin 28 is free to rotate together with the shaft 25 according to the spring of the particular shoe. Then, in the thrust stage of the lasting operation, the pin 28 moves in the wide part of the guide 36. If now the ball wiper 16 is drawn back out of its end position with a rotation suited to the spring of the shoe, the pin 28 also runs back so that it impinges against the wedge shaped part 38 of the guide 36 and is automatically guided by the wedge shaped part 38 into the narrow part 37. In this way the ball wiper 16 must always automatically resume the same starting position independently of the spring of the particular shoe.

The ball wiper 16, as shown in FIG. 11, can be moved from the position oblique to the last, as shown, e.g., in FIG. 4, into the position according to FIG. 6 in which it is pressing the lasting margin 23 against the insole 21. The housing 27, shown in FIG. 11, is mounted on an axis 39 so that a raising or lowering of the housing 27 in the zone of the piston-cylinder arrangement 31, 32, 33 results in a corresponding countermotion of the ball wiper 16. This movement of the housing is produced by a piston-cylinder unit 40 which acts upon the housing 27 directly through a lug 41.

Figure 13:
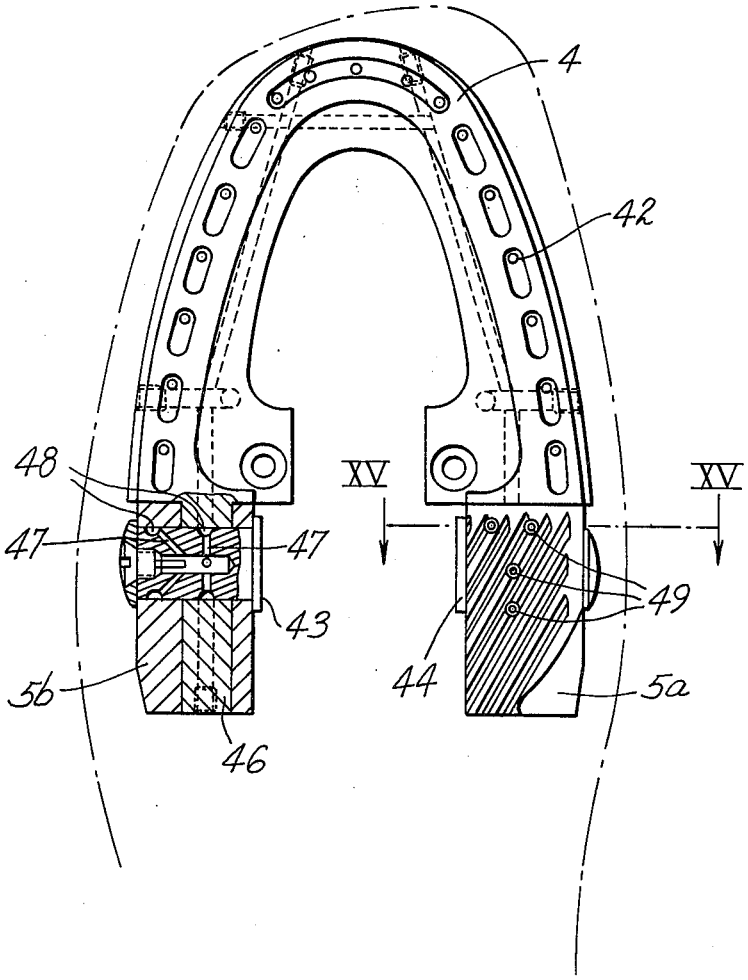
FIG. 13 is a plan view of the injection plate.
Figure 14:
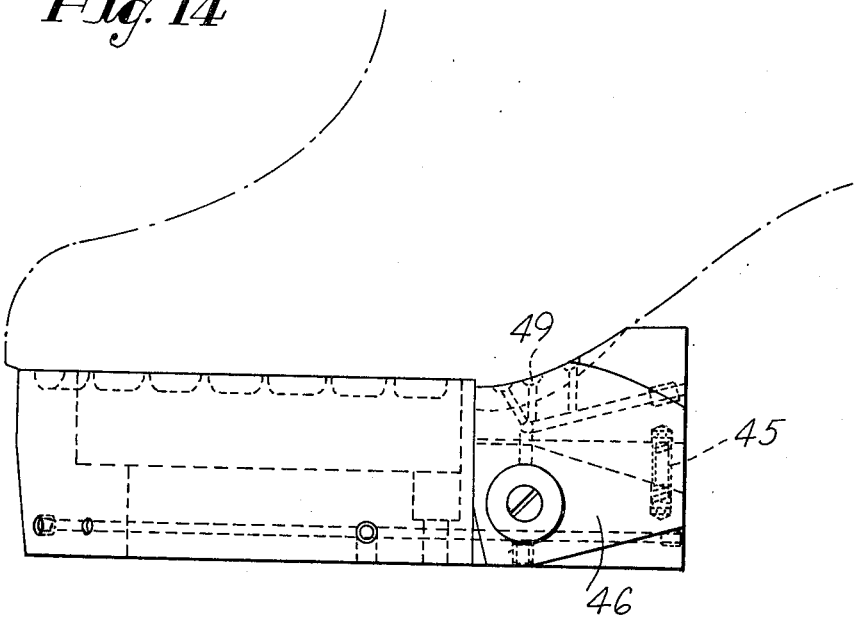
FIG. 14 is a view of the same injection plate in a side view.
Figure 15:
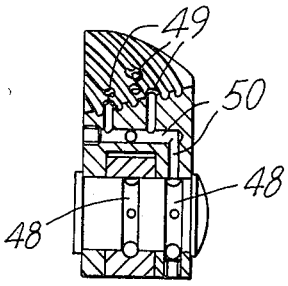
FIG. 15 is a view taken along the lines XV—XV of FIG. 13.

FIGS. 13 and 14 show in plan view and in side view respectively the injection plates 4, 5 whereby component 4 is assigned to the toe point zone and component 5 to the ball zone as an extension piece. Component 4 is constructed in a known way and fitted with cement nozzles 42. The extension piece 5 consists of two parts 5*a* and 5*b* which are individually articulated to the front piece 4 by a pair of pivot pins 43 and 44. The two parts 5*a* and 5*b* of the extension piece are individually rotatably arranged to be in relation to the front part 4, and thus can adapt themselves to the spring of the shoe that is being lasted. This adaptation is automatic because an arrangement of springs 45 is adapted to parts 5*a* and 5*b* of the extension piece. These springs 45 are supported on a member 46, as a component of the front part 4. At the other end the springs press directly against the extension piece 5*a* or 5*b*.

In order now that cement can be delivered in a simple way to the extension piece 5*a*, 5*b*, the pivot pins 43, 44 are provided with drilled ducts 47 both axially and radially to which the cement is delivered axially. The cement then passes into a ring groove 48, from which it passes directly into the extension piece 5*a* or 5*b* and is then delivered to an array of cement nozzles 49 through corresponding apertures.

The cement flows from the ring grooves 48 via apertures 50 to the cement nozzles 49.

Having thus described our invention, what we claim as new and desire to secure as Letters Patent of the United States is:

1. A machine for cement lasting of shoe uppers and insoles on a last disposed on a shoe support, said lasting being performed in the toe point and the ball zones of said insole, said machine comprising:

a pair of obliquely forwardly directed ball zone wipers for lasting a portion of said upper therewith in a first stage;

a pair of fold distributors in a second stage for pushing over the lasting margin after withdrawal of said first stage wipers, said fold distributors having bent front edges such that they press resiliently against the edge of the shoe bottom in a generally normal angle of incidence and which generally overlap the zone of wiping of said ball wipers; and a lasting wiper comprising a third stage arranged between the shoe bottom and said fold distributors wherein problem creases are omitted from the shoe bottom, especially at the ball zone.

2. A machine as recited in claim 1 wherein said upper is held by a toe band prior to the activation of said ball wipers; and after the activation of said ball wipers, said upper is held against the last by a pair of side pressure rams arranged above said ball wipers.

3. A machine as recited in claim 1 wherein said ball wipers are arranged laterally of and are directed obliquely forward to the shoe being operated upon;

said lasting wipers of said third stage and said fold distributors being fitted on a wiper head which is movable toward and away from the shoe being operated upon.

4. A machine as recited in claim 3 wherein each of said ball wipers is disposed on the end of a piston rod;

said piston rod being arranged so as to execute a thrust movement and a stroke movement directed to the shoe bottom wherein said ball wipers are mounted to permit their rotation about their longitudinal axis in the lengthwise direction of the shoe bottom to allow automatic adaptation of said wipers to the curve of the shoe bottom.

5. A machine as recited in claim 4 wherein said piston rod is supported by a piston-cylinder which is rotatably mounted about an axis parallel to said shoe support which permits the stroke movement of said piston rod.

6. A machine as recited in claim 5 wherein said piston rod has a laterally protruding pin which slides in a wedge shaped guide disposed in a guide plate, said wedge shaped guide having its incrementally widening dimensions increasing in the direction of thrust of said ball wipers.

7. A machine as recited in claim 6 wherein said fold distributors are comprised of steel strips having bent portions at their distal end, said bent portions being directed toward the shoe bottom.

8. A machine as recited in claim 7 wherein said lasting wiper of said third stage has recesses disposed therein and when said lasting wipers are in the open state said bent portions of said fold distributors are disposed therewithin.

9. A machine as recited in claim 7 which also includes an injection plate for applying cement to the ball zone of said shoe bottom;

said injection plate is comprised of a rotatably articulated extension piece, said injection plate being pressed against the ball zone by an arrangement of springs.

10. A machine as recited in claim 9 wherein cement is delivered to said rotatably articulated extension piece by an arrangement of drilled ducts in its axis, said cement being conducted through a plurality of ring grooves reaching the surface of said injection plate through apertures permitting adhesion of the cement to said insole.

* * * * *